United States Patent [19]

Airey

[11] Patent Number: 4,756,372

[45] Date of Patent: Jul. 12, 1988

[54] TOOL FOR CLOSING A WELL TUBING

[75] Inventor: Peter Airey, Vulaines-sur-Seine, France

[73] Assignee: Schlumberger Technology Corporation, Houston, Tex.

[21] Appl. No.: 99,683

[22] Filed: Sep. 17, 1987

Related U.S. Application Data

[63] Continuation of Ser. No. 918,467, Oct. 14, 1986, abandoned.

[30] Foreign Application Priority Data

Oct. 18, 1985 [FR] France ..... 85 15490

[51] Int. Cl.[4] ..... E21B 34/14

[52] U.S. Cl. ..... 166/319; 166/332; 166/373; 166/385

[58] Field of Search ..... 166/319, 320, 332, 373, 166/385, 386, 72

[56] References Cited

U.S. PATENT DOCUMENTS

| | | | |
|---|---|---|---|
| 2,033,563 | 3/1936 | Wells | 166/320 X |
| 2,962,099 | 11/1960 | Clark, Jr. | 166/320 |
| 3,115,188 | 12/1963 | Cochian et al. | 166/332 |
| 3,448,803 | 6/1969 | Sizer | 166/319 X |
| 3,703,104 | 11/1972 | Tamplen | 166/332 X |
| 3,735,813 | 5/1973 | Mack | 166/319 X |

*Primary Examiner*—Stephen J. Novosad

*Attorney, Agent, or Firm*—Henry N. Garrana; Mary M. Yawney; E. R. Archembeau, Jr.

[57] ABSTRACT

The invention relates to a tool having a valve (3*c*, 4*c*) for closing the tubing (100) of a well into which the tool has been placed. The valve member (4*c*) is controlled by means of a traction cable (17) via a hydraulic mechanism having two piston-and-cylinder assemblies (4*b*, 5*e*, 45; 1*g*, 4*a*, 41) which reduce the force applied on the valve member (4*c*) by the pressure of the fluid in the well and which amplify the force (f) applied thereto by the cable (17) in order to open said valve member.

11 Claims, 6 Drawing Sheets

17
5a
2i
2f
5b
2
1a
2c
12
2d
1
33
13
3b
45
4e
4a
14
5e
1g
70
5g
6
6c
100
2g
1b
5c
100a
11
101
2a
5
2b
1c
1d
3
4c
41
5d
4
31
4d
5f
5h
6b
5i
15

17
5a
2f
2j
II
2c
12
1b
2a
101
2b
13
3b
3
28
41
4b
14
I
6
1f
4c
4a
45
5e
5k
16
6a

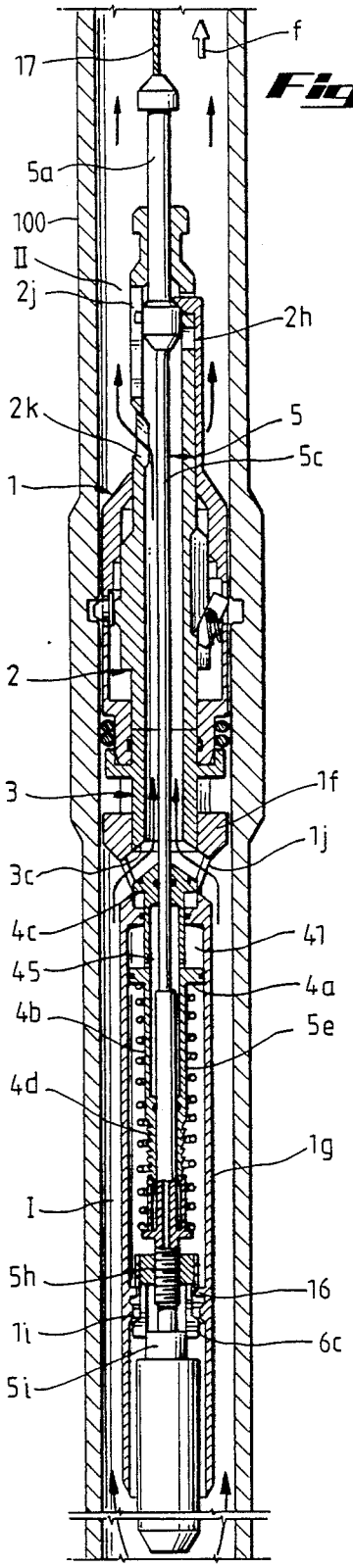
Fig. 5
Fig. 6
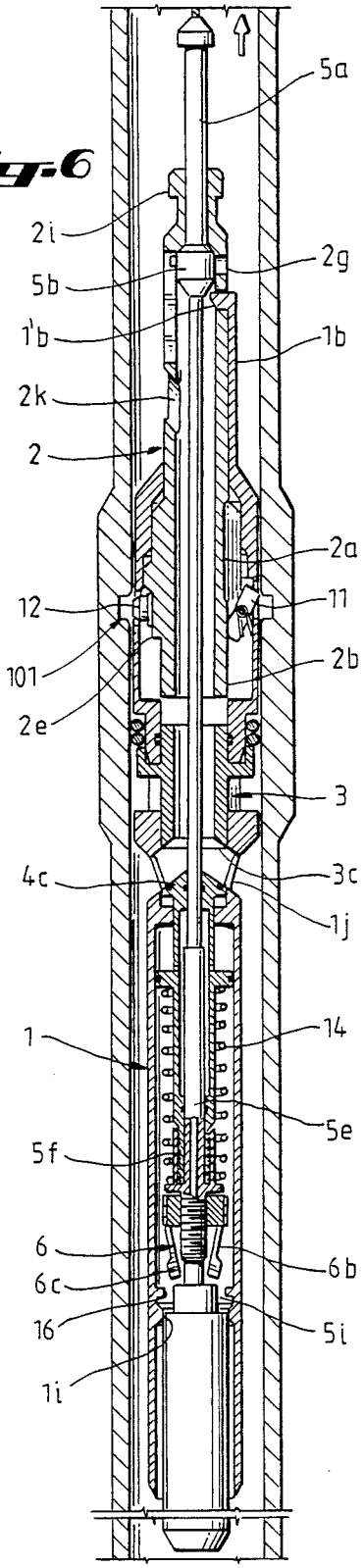

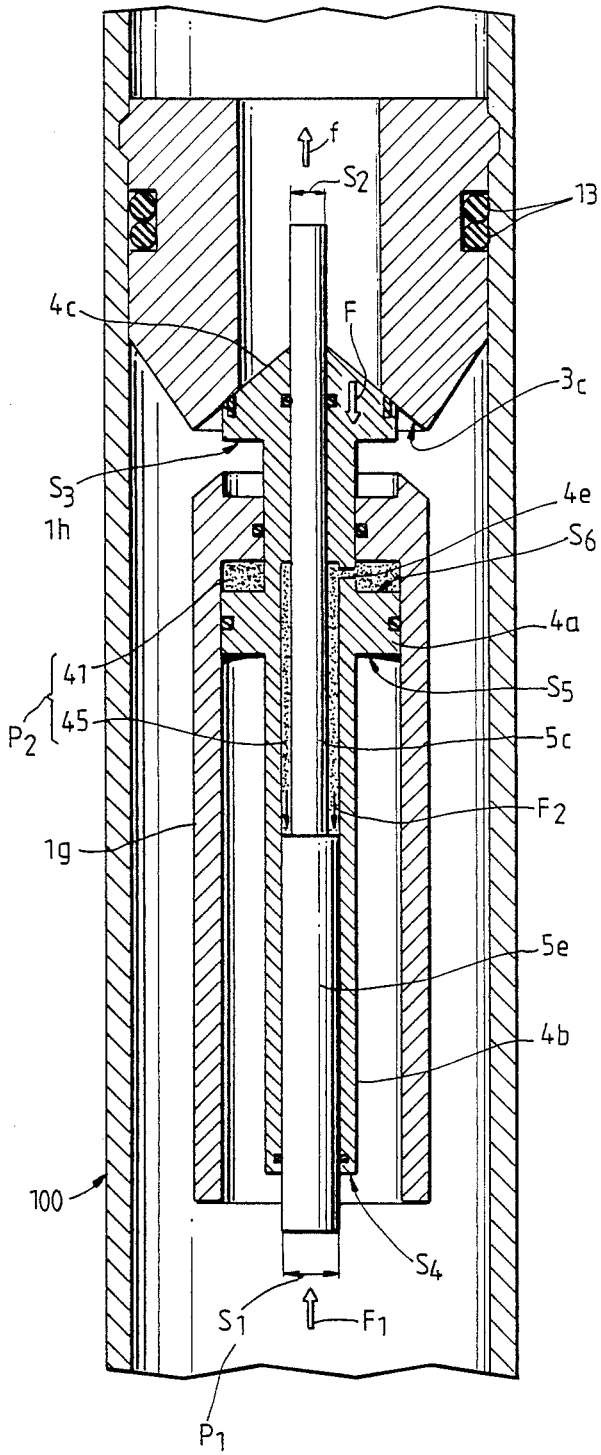
Fig.7
Fig.8
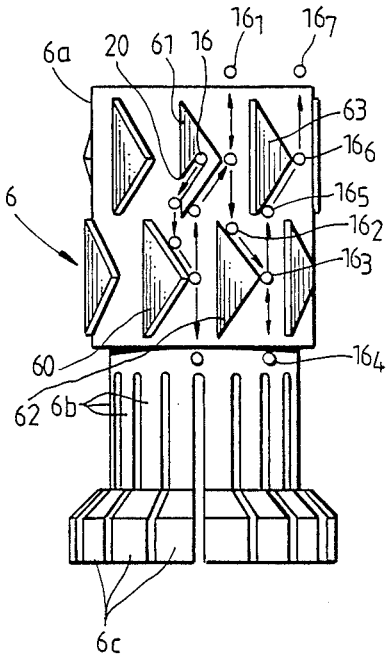

TOOL FOR CLOSING A WELL TUBING

This application is a continuation of U.S. application Ser. No. 918,467, filed Oct. 14, 1986, now abandoned.

The present invention relates to a tool for closing the tubing of a well containing a fluid under pressure, said tool being designed to be temporarily fixed inside the tubing or else to constitute an integral portion thereof and including a valve capable of being operated to close and open the tubing to the passage of well fluid.

BACKGROUND OF THE INVENTION

One of the main tests for determining the production capability of a hydrocarbon well exists in stopping production by means of a valve and in recording the changes in pressure due to the well being closed. It is advantageous to be able to close the tubing in the immediate proximity of the underground productive zone in order to eliminate various interfering effects which appear when the closure is performed at the surface because of the compressibility of the fluid present in the tubing.

Preferred embodiments of the present invention provide a closure tool capable of being installed in the tubing of a well while tests are performed on the well, with the valve of said tool being easy to operate in spite of the considerable pressure which may exist in the well and which opposes re-opening the valve once it has been closed.

SUMMARY OF THE INVENTION

According to the present invention, the valve of such a tool is coupled to a hydraulic mechanism comprising first and second piston-and-cylinder assemblies having respective variable volume chambers of different cross-sectional areas, said chambers communicating with each other and being filled with a hydraulic liquid, wherein the piston of the first assembly acts on the valve in its closure direction under the effect of the pressure of the hydraulic liquid to which it is subjected, said piston having an inside face in contact with the hydraulic liquid which is of larger cross-sectional area than the cross-sectional area of the inside face of the piston of the second assembly, thereby obtaining a multiplying effect on the force applied to the piston of the second assembly in order to cause the valve to open.

Advantageously the piston of the second assembly has an outside cross-sectional area which is subjected to the pressure of the well upstream from the valve, which area is greater than the cross-sectional area of the inside face of said piston. By means of this disposition, the valve, when in the closed position, receives a force in the opening direction from the piston of the first assembly which is subjected to the pressure of the hydraulic liquid, which pressure is greater than the ambient pressure in the well where the tool is located, and this force opposes the force which the valve receives directly from the fluid under pressure in the well which pressure tends to close the valve. Thus, the net force on the valve is reduced and it can be opened by applying a control force which is less than the force which would be necessary if the hydraulic mechanism were absent, and as a result there is no need to provide means for equalizing the pressure on both sides of the valve prior to opening it. This effect is enhanced by the above-mentioned force-multiplying effect and thus leads to a further reduction in the force that needs to be applied to open the valve.

In an advantageous embodiment, the piston of the second assembly slides in the corresponding cylinder along the longitudinal axis of the tool, and it is disposed in such a manner that when it is urged to the end of the tool which is the top end when the tool is installed in a well. it causes the volume of the chamber of said assembly to be reduced. Consequently, the volume of the chamber of the second assembly is reduced by applying a traction force to a cable attached to said piston and rising to the surface inside the production column, thereby increasing the volume of the first assembly and thus causing the valve to open.

In practice, the valve is normally constituted by a complementary valve element and seat, with the valve element being fixed to the piston of the first assembly.

In a preferred embodiment, the structure of the hydraulic mechanism has a coaxial configuration. More precisely, said valve element may be fixed to a cylindrical tube whose axis is parallel to the direction of valve element displacement, said tube having the piston of said first assembly projecting outwardly therefrom in the form of an annular piston slidably mounted in a fixed cylindrical tube which constitutes the side wall of the cylinder of the first assembly and which is closed by a transverse partition situated between the valve element and the piston, said tube fixed to said valve element being mcunted to slide in sealed manner through said partition, and said tube also constituting the side wall of the chamber of said second assembly, which chamber communicates with the chamber of said first assembly via at least one orifice through said wall, the piston of said second assembly being slidably mounted in said tube and being fixed to an actuator rod capable of sliding in sealed manner through said valve element and having a cable attached thereto for causing said valve to open when traction is applied to the cable by displacing said valve element via said hydraulic mechanism.

When the tool is a removable tool which is fixed only temporarily in a well tubing, the tool may be made lockable at the desired level by the tube constituting the side wall of said first assembly extending beyond said partition delimiting the chamber of said first assembly in the form of a generally tubular portion including at least one dog and at least one latching key capable of being retracted into said tubular portion and of being caused to project radially out therefrom in order to engage in a peripheral groove included in a landing nipple of said tubing at the location where the tool is to be situated, radial movements of said dog and said latching key being controlled by a tubular part which is movable in the direction of the longitudinal axis of the tool and which is disposed coaxially inside said tubular portion into which the dog and key may be retracted and including camming zones at differing radiuses for engaging said dog and said latching key, with the positions of the dog and the latching key depending on the particular tubular part camming zone with which they are engaged.

Preferably, said tubular part having camming zones is capable of occupying three predetermined positions relative to said tubular portion into which the dog and the latching key may be retracted, said positions comprising a first position in which said dog is free to project under the effect of a spring and said latching key is retracted, a second position in which said dog is retracted and said latching key is extended, and a third position in which both the dog and the latching key are retracted, said tubular part being moved from its first position to its second position and then to its third position under the control of longitudinal displacements of the piston rod of said second assembly under the effect of successive traction forces applied to the cable attached to said rod. In the first position of said part, the dog stops the tool in the connection length with an inside bearing surface; in the second position the latching key locks the tool in place; and in the third position the tool is unlocked and may be raised.

In order to cause the tubular part to move from one of its positions to the next, said tubular portion is initially in its first position and said valve member displaces said tubular portion to its second position on the first occasion that said valve member is closed under the control of said piston rod of said second assembly. Further, in order to unlock the tool after a predetermined number of valve opening and closing cycles, said piston rod of said second assembly is coupled to an indexing member which advances by one step each time said piston rod executes a go-and-return stroke corresponding to an opening and closing cycle of the valve, and said indexing member limits the stroke of the piston rod in the valve opening direction until a predetermined number of steps have been accomplished, after which said member allows said piston rod stroke to continue further, thereby causing said tubular part to move from its second position to its third position, thereby releasing the tool for raising.

In order to hold the valve member open during the final tool-raising stage, said piston rod and said tube fixed to said valve member may be are provided with hooking members, whereby they lock together when the rod performs its extended stroke which unlocks the tool, the valve member then being maintained in its open position.

BRIEF DESCRIPTION OF THE DRAWINGS

An embodiment of the invention is described by way of example with reference to the accompanying drawings, in which:

FIGS. 3 to 6 are longitudinal sections through the tool shown in FIGS. 2A and 2B, drawn to a smaller scale and showing different stages of operation;

FIG. 7 a diagrammatic section through the portion of the tool which includes the hydraulic actuator mechanism for the closure valve in the tool; and FIG. 8 a diagram showing the operation of the tool indexing member for limiting the number of valve opening and closing cycles.

MORE DETAILED DESCRIPTION

Figure 1:
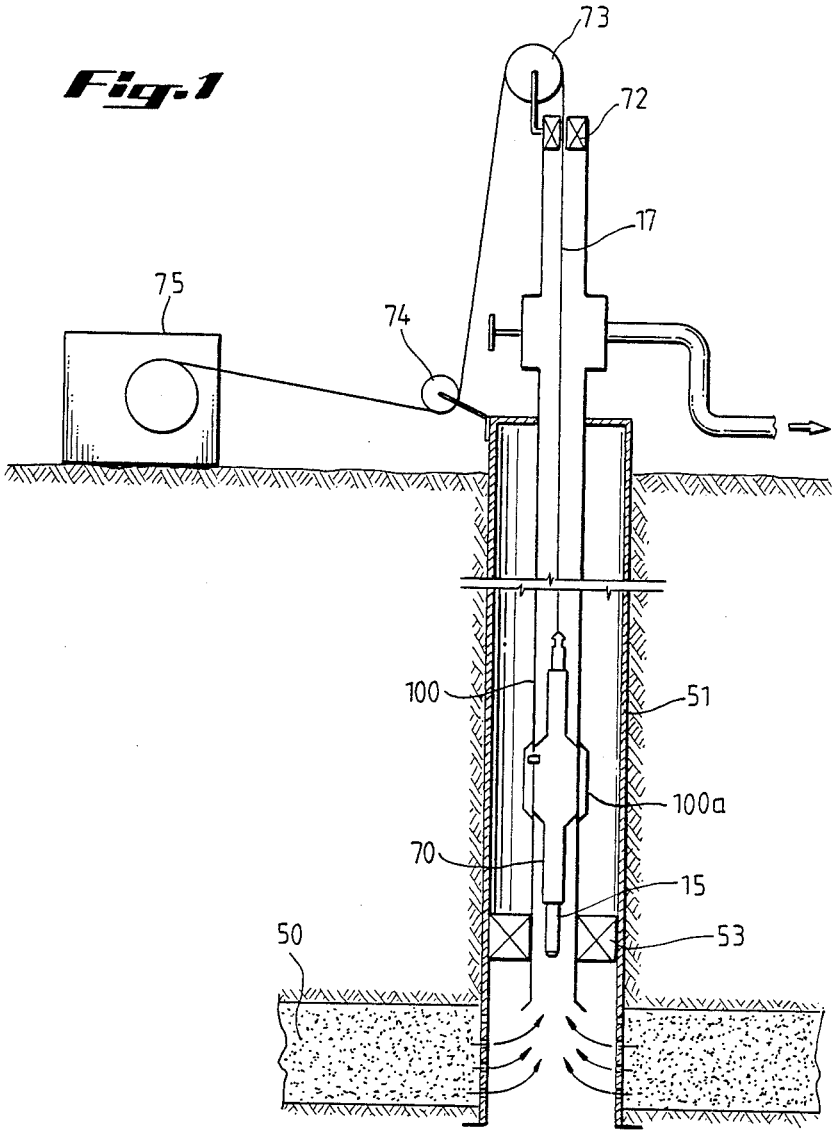
FIG. 1 is a diagrammatic vertical section through a well in which a closure tool in accordance with the invention has been placed.

FIG. 1 shows a well drilled into an oil production zone 50. The well comprises a tubing 100 inside casing 51, an annular sealing device or packer 53 is placed between the bottom end of the tubing and the casing 51. A closure or "shut-in" tool 70 in accordance with the invention is lowered to a short distance above the level of the production zone 50 by means of a cable 17 from which it is suspended. This cable passes along the inside of the tubing 100 and emerges from the top thereof through a sealing device 72 and is then directed by pulleys 73 and 74 to the drum of a winch 75 disposed on the surface of the ground and onto which the cable is wound. The cable 17 is an electric cable which in addition to providing the mechanical function of suspending and actuating the tool 70 also provides the function of transmitting measurement signals to the surface from devices which may be associated with the tool, such as a pressure gauge 15 for measuring the pressure at the bottom of the well below the tool.

In the following description of the closure tool 70, it is assumed that the tool is in its normal in-use position in a vertical well.

Figure 2A:
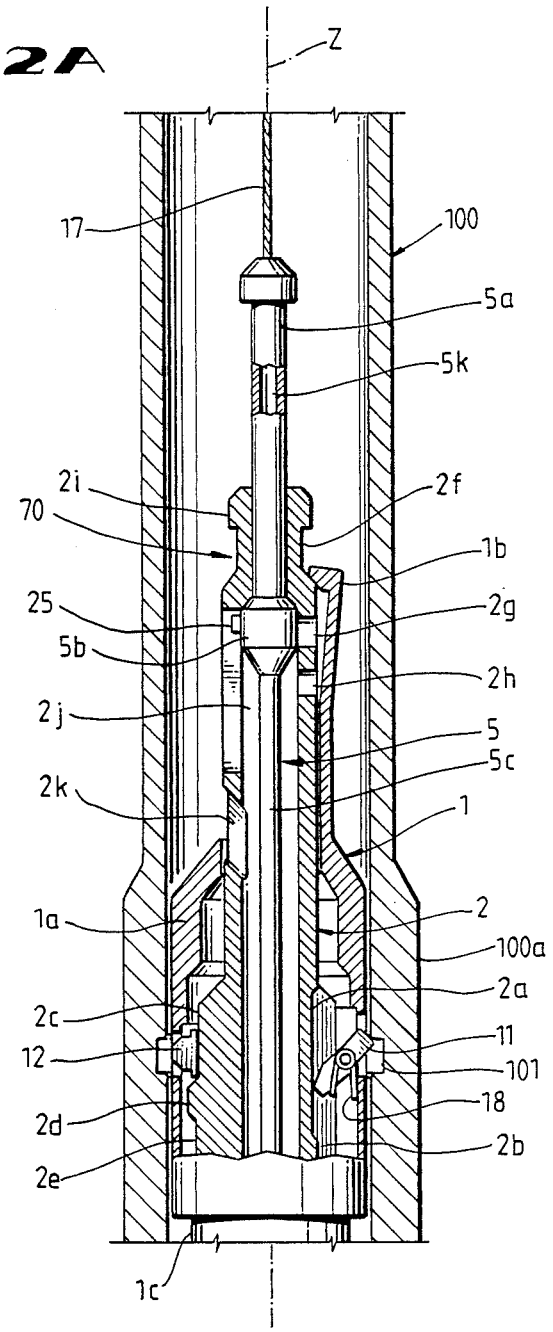
FIGS. 2A and 2B are respectively the top half and the bottom half of a longitudinal section through a tool in accordance with the invention.
Figure 2B:
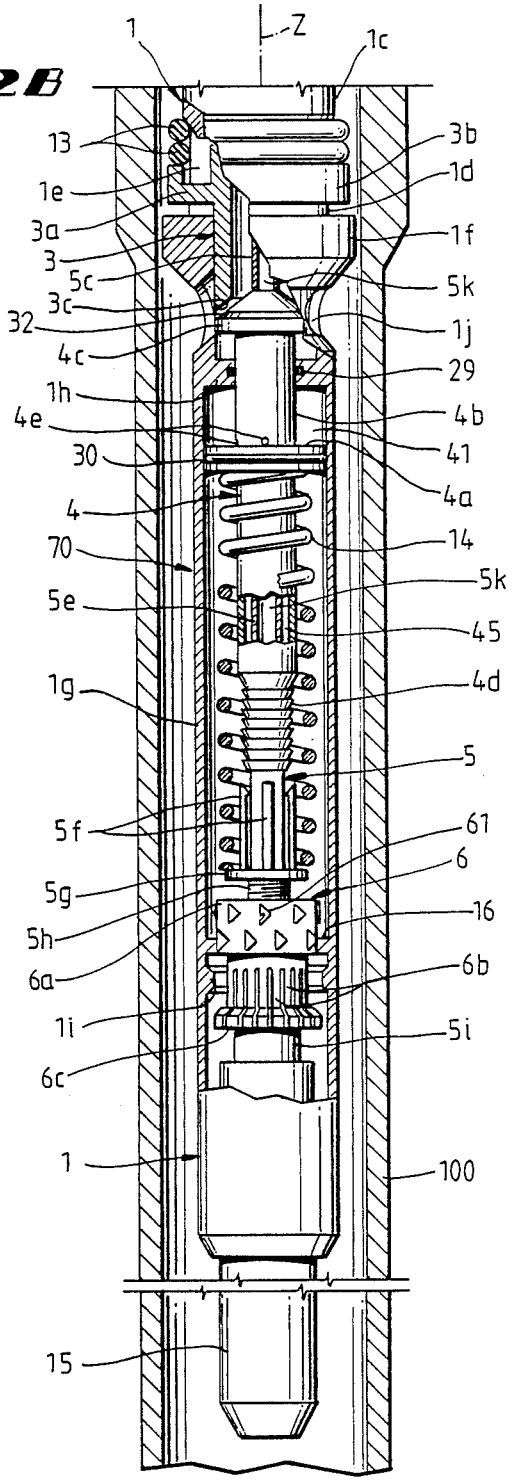

The tool shown in FIGS. 2A and 2B comprises a first tubular part 1 of considerable length. The head end **1*a* of this part is enlarged to be of substantially the same diameter as the inside diameter of the tubing 100 down which the tool is lowered, and it encloses a second tubular part 2 which projects upwardly out from the first part 1, and a third tubular part 3 located below the part 2. Below the part 3, the first part 1 contains a fourth tubular part 4. Finally a fifth tubular part 5** is provided running along the full length of the longitudinal axis Z of the tool. These five parts are capable of sliding longitudinally relative to one another.

The head **1*a* of the first part 1 contains trailing dogs 11 and locking keys 12 capable of projecting from its periphery via corresponding orifices to engage in a groove 101 provided in a landing nipple 100*a*. of the tubing 100 provided at the level where the tool is to be located. Each trailing dog 11 has a spring 18 which urges it out from the head 1*a* of the part 1 and trails so that while the tool is being lowered down the tubing 100 the dog can pass over any obstruction it may encounter on the inside wall of the tubing but so that when the tool is moved upwardly it engages in a cavity such as the groove 101 to stop the tool. In order to avoid impeding the rocking movement of the dogs 11, the second part 2 has a portion of reduced radius facing each of the dogs and extending axially along a zone 2*a* which terminates with a chamfer to a greater radius zone 2*b* situated beneath the zone 2*a* such that if the zone 2*b* comes level with the corresponding dog 11 by virtue of the part 2 sliding relative to the part 1, then the chamfer and the zone 2*b* serve to cam the corresponding dog into its retracted position inside the head 1*a* of the part 1**.

Depending on the position of the second part 2 relative to the first part 1, the second part 2 has three zones **2*c*, 2*d* and 2*e* for engaging each of the latching keys 12. The middle zone 2*d* is of greater diameter than the other two and serves to cam the corresponding key 12 out from the head 1*a* to engage in the groove 101, whereas the upper and lower zones 2*c* and 2*d* allow the latching key 12 to take up a retracted position inside the head 1*a***. Suitable chamfers are provided between the middle zone 2d and the adjacent zones 2c and 2e.

The part 1 extends upwarily beyond its head **1*a* in the form of an elongate resilient hook 1*b* which, depending on the relative positions of the parts 1 and 2 may engage either in a peripheral groove 2*f* provided in the top of the part 2 or else in one of two holes 2*g* and 2*h* going through the wall of the part 2 one below the other and both of them below the groove 2*f***.

Below its head **1*a*, the part 1 has a first cylindrical zone 1*c* of slightly smaller diameter than the head 1*a*. with the bottom of the first cylindrical zone 1*c*** being connected via a conical chamfer to a second cylindrical zone 1*b* of slightly smaller diameter than the zone 1*c*. The zone 1*d* has axially extending slots 1*e* through which radially extending arms 3*a* on the third part 3 extend and support a ring 3*b* which is topped with a pair of sealing rings 13. Below its zone 1*d*, the part 1 has a portion 1*f* of larger diameter which is of substantially equal diameter to the head 1*a*, and then it continues to its bottom end in the form of a long thin-walled tube 1*g* of slightly smaller diameter. An annular piston 4*a* belonging to the part 4 is mounted to slide axially inside the tube 1*g*. *Above the annular piston 4a* there is an outwardly extending thin-walled tube 4*b* capable of sliding through an axial opening in an annular partition 1*h* inside the part 1 at the top of its tube 1*g*. Above this partition, the part 4 expands to form a conical head 4*c* which constitutes a valve element for cooperating with a seat 3*c* of complementary shape formed in the bottom end of the part 3. Below the piston 4*a*, the tube 4*b* extends downwardly and terminates in a portion 4*d* whose external surface is in the form of a ratchet.

The part 5 has a head 5*a* which is generally cylindrical and which is engaged in the top portion of the part 2 and is capable of sliding in a sleeve 2*i* which terminates said part 2. The inside diameter of the sleeve 2*i* is slightly smaller than the inside diameter of the remainder of the part 2. Immediately below the head 5*a* there is a portion 5*b* of greater diameter capable of sliding in the larger diameter portion of the part 2, but too large to pass through the sleeve 2*i* thereof, thus limiting the upward extent by which the part 5 can move relative to the part 2. The larger diameter portion 5*b* also includes a peg 25 which is engaged in a guide sIot 2*j* which passes through the wall part 2 and extends axially so that the parts 2 and 5 are capable of sliding longitudinally relative to each other but are constrained to rotate together about their common axis Z.

It may be observed that the above-mentioned groove 2*f* is located in the outside wall of the sleeve 2*i*, while the orifices 2*g* and 2*h* are located below the sleeve 2*i* in the cylindrical region of the part 2 where the larger diameter portion 5*b* slides.

Below its head 5*a*, the part 5 continues in the form of a long thin rod 5*c* which passes axially through the part 1, the bottom of the part 2, the part 3, and the part 4. An annular gap is left between the rod 5*c* and the inside cylindrical surfaces of the parts 2 and 3, but where it passes through the valve element 4*c* of the part 4, the rod 5*c* passes through an axial orifice of matching diameter. Below the valve 4*c*, an annular gap extends between the inside of the tube 4*b* and the rod 5*c*. The rod then has a portion 5*e* of slightly larger diameter than the portion 5*c* with an annular shoulder 5*d* (see FIG. 3) between said portions. The larger diameter portion 5*e* emerges from the bottom of the ratchet portion 4*d* of the part 4.

At the bottom of the larger diameter portion 5*e*, the part has a set of upwardly-directed claws 5*f* which extend axially and which are suitable for engaging the ratchet portion 4*d* of the part 4, thereby coupling the parts 4 and 5 together in a releasable manner. The bottom ends of the claws 5*f* stand on a collar 5*g* and a compression spring 14 extends between the collar 5*g* and the piston 4*a* tending to urge the piston 4*a* upwardly relative to the part 5.

A pressure gauge 15 for measuring the fluid pressure in the well is fixed to the bottom end of the part 5. Electrical connection wires from the pressure gauge pass along the entire length of the tool via an axial bore 5*k* running along the entire length of the part 5 and these wires are connected to the electric cable 17 which is fixed to the head 5*a* of the part 5.

The part 5 also has a zone 5*h* with an outside thread followed by a zone 5*i* of greater diameter than the average diameter of the threaded zone 5*h*. A part 6 is engaged around this portion of the part 5. The part 6 comprises a sleeve 6*a* having a tapped bore for screwing onto the threaded zone 5*h* and having downwardly extending legs 6*b* each of which is terminated by an outwardly-directed foot 6*c*. The legs 6*b* are resilient and tend to move the feet inwardly towards the central axis Z of the tool. Depending on the position of the part 6 relative to the part 5 (which depends on where it is screwed along the threaded portion 5*h*), the "heels" of the feet 6*b* are either pressed against the relatively large diameter portion 5*i* so that the feet 6*c* are held radially outwardly and substantially in contact with the inside surface of the tube 1*g* of the part 1, so that they are in a position to come into abutment against an inwardly-protecting shoulder 1*i* from said inside surface, or else the "heels" of the feet 6*c* are free to move resiliently inwardly towards the smaller diameter portion 5*h* of the part 5, thereby retracting the feet 6*c* and allowing the part 6 to move past the shoulder 1*i* of the part 1.

The periphery of the sleeve 6*a* on the part 6 has triangular projections 61, 62, . . . occupying two staggered rows. The diameter of the sleeve 6*a*, the thickness of said projections, and the diameter of the above-mentioned shoulder 1*i* are chosen so that the part 6 can move freely relative to the shoulder 1*i*, but with the projections 61, 62, . . . coperating with a pair of pegs 16 which project inwardly from the inside of the tube 1*g* of the part 1 at diametrically opposite locations so as to cause the part 6 to rotate through a fraction of a turn relative to the part 1, and consequently relative to the parts 2 and 5 which are constrained to rotate with the part 1. This fraction of a turn occurs each time the two rows of projections 61, 62, . . . pass between the pegs 16.

This is shown in greater detail in FIG. 8, where for the purpose of simplifying the drawing, the part 6 is assumed to be fixed and the pegs 16 of the part 1 are assumed to move. Supposing that the peg 16 starts from an initial position $16_1$ and moves axially downwardly, it then encounters the projection 62 at $16_2$, thereby being deflected to the right to $16_3$, after which it continues axially to reach a position 164 from which it will subsequently rise to encounter the projection 63 at $16_5$ and again be deflected to the right as far as $16_6$ from which it moves axially to a final position $16_7$ which is level with the starting position $16_1$ but which is angularly displaced therefrom by a fraction of a turn. In reality, the peg 16 is fixed and it is the part 6 which turns through said fraction of a turn, and to the left. The part 6 can thus be used as an indexing member that counts the number of go-and-return strokes executed by the part 5 on which it is screwed.

The part 4 co-operates with the following sealing rings: a ring 28 (see FIG. 4) between the valve element 4*c* and the rod 5*c*; a ring 29 (see FIG. 2B) between the partition 1*h* and the tube 4*b*, a ring 30 between the piston 4*a* and the tube 1*g*; a ring 31 (see FIG. 3) between the bottom portion 4*d* of the part 4 and the corresponding portion 5*e* of the part 5; and finally a ring 32 (see FIG. 2B) on the valve element 4*c* and facing its seat 3*c*. A sealing ring 33 is also provided in the zone 1*c* of the part 1 and co-operates either with the part 2 (see FIG. 3) or else with the part 3 (see FIG. 4).

The above-described disposition includes two cylinder-piston assemblies: a first assembly comprises a cylinder formed by the tube 1g and the piston 4a on the part 4 which is fixed to the valve element 4c; and a second assembly comprises a cylinder formed by the tube 4b and a piston formed by the portion 5e of the part 5 which is of greater diameter than the portion 5c located thereabove and constituting an actuator rod. The variable volume chamber 41 of the first assembly is delimited by the tube 4b, the piston 4a, the tube 1g, and the partition 1h, and it communicates via orifices 4e through the tube 4b with the variable volume chamber 45 of the second chamber which is itself delimited by the rod 5c, the shoulder 5d, the tube 4b, and the valve element 4c. These two chambers are filled with hydlraulic liquid.

By virtue of the presence of the hydraulic mechanism constituted by the communicating hydraulic fluid filled chambers 41 and 45 together with their respective pistons 4a and 5c, the valve element 4c (which is in its closed position after the tool has been lowered down the well) is subjected by the fluid under pressure in the well to a force which tends to urge it against its seat 3c while it receives a force in the opposite direction from said hydraulic fluid via the piston 4a. These two forces oppose each other so that the total force with which the valve element 4c is pressed against its seat 3c in the closure position is reduced.

If the cross-sectional areas of the portions 5e and 5c of the part 5 are respectively denoted $S_1$ and $S_2$ (see FIG. 7) then the effective piston area of the chamber 45 is $S_1-S_2$ The fluid in the well is at a pressure $P_1$ and exerts a force $F_1=P_1S_1$ on the part 5 in an upward direction, while the fluid in the chamber 45 is at pressure $P_2$ and exerts a force $F_2=P_2S_2$ on the part 5 in a downward direction. Since the part 5 is in equilibrium between the well fluid at pressure $P_1$ and the fluid above the valve element 4c whose pressure is negligible:

$$F_1=F_2$$

and thus $$P_2=P_1.S_1/S_2.$$

Given that $S_1$ is greater than $S_2$, the pressure $P_2$ in the two-part chamber 41, 45 is greater than the pressure $P_1$ in the well.

Let the areas of the valve element 4c, the portion 5e of the part 5 and the piston 4a which are subjected to the pressure $P_1$ be denoted respectively $S_3$, $S_4$, and $S_5$. Let the area of the piston 4a which is subjected to the pressure in the fluid 41 be $S_6$. It can then be seen that the valve element 4c is subjected to:

an upward force $F_h$ from the pressure $P_1$ of:

$$F_h=(S_3+S_4+S_5)\,P_1, \text{ and}$$

a downwards force $F_b$ from the pressure $P_2$, where $$\begin{aligned} F_b &= (S_6-(S_1-S_2))\,P_2 \\ &= (S_6-(S_1-S_2)\cdot(S_1/S_2)\,P_1. \end{aligned}$$

Suppose for the purposes of simplification that $$S_4<<S_5,\ S_1-S_2<<S_6, \text{ and } S_6\simeq S_5\simeq S_3,$$

then:

$$F_h=2\,S_3\,P_1$$

$$F_b=S_3.(S_1/S_2).P_1$$

whence $$F_b=(S_1/2S_2).F_h.$$

Supposing the values of $S_1$ and $S_2$ are selected, for example, to be respectively equal to 2 $cm^2$ and 1.5 $cm^2$, it can be seen that the downward force $F_b$ created by the hydraulic fluid in the chamber 41 is equal to two-thirds of the upward force $F_h$ exerted by the well fluid, so that the resultant force $F_h-F_b$ to which the valve member 4c is subjected in the closure direction is reduced to one-third of the force $F_h$ to which it would be subjected if the two-piston hydraulic mechanism were absent.

This mechanism also has an amplifying effect on the force f which needs to be applied to the part 5 via the cable 17 in order to open the valve element 4c. Such a force f sets up a pressure variation:

$$\Delta P_2=f/(S_1-S_2)$$

in the chamber 45 and this carries through to the chamber 41 so that the pistons 4a apply an opening force F to the valve element 4c where $$F=S_6.\Delta P_2=(S_6/(S_1-S_2))\,f.$$

With the values given above by way of example for $S_1$ and $S_2$, and giving $S_3$ the value of 15 $cm^2$, it can be seen that the force-amplifying coefficient $S_6/(S_1-S_2)$ is 30. Consequently, by virtue of the hydraulic mechanism actuating the valve element 4c, the traction force f which needs to be applied to the cable 17 in the present practical example in order to operate the valve 4c is $30\times3=90$ times smaller than the force which would need to be applied directly to the valve if said hydraulic mechanism were absent.

The operation of the tool is now described.

Figure 3:
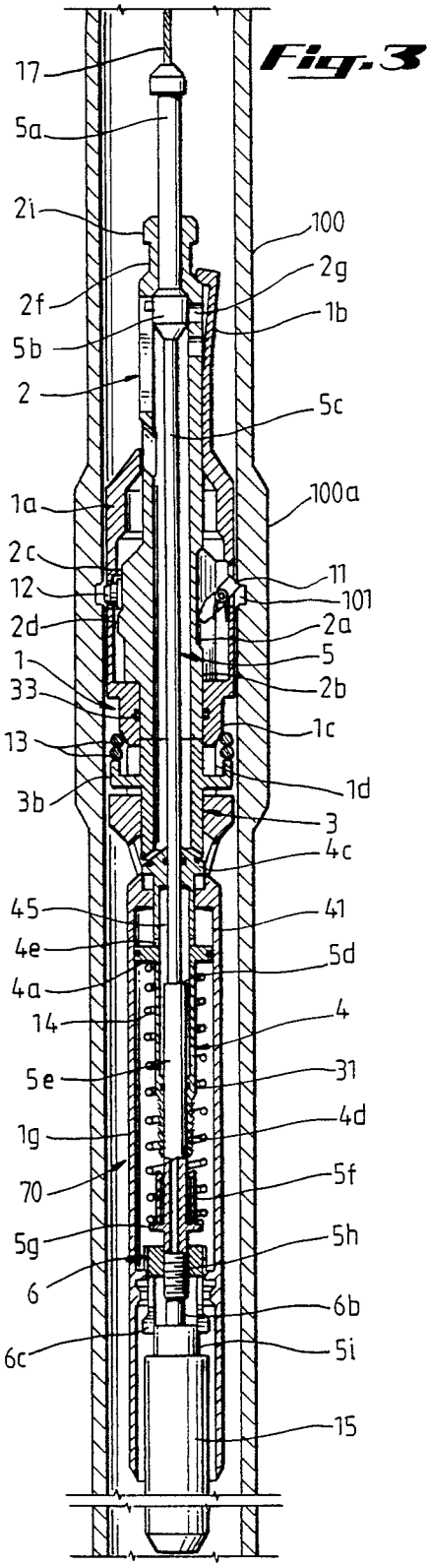
Figure 4:
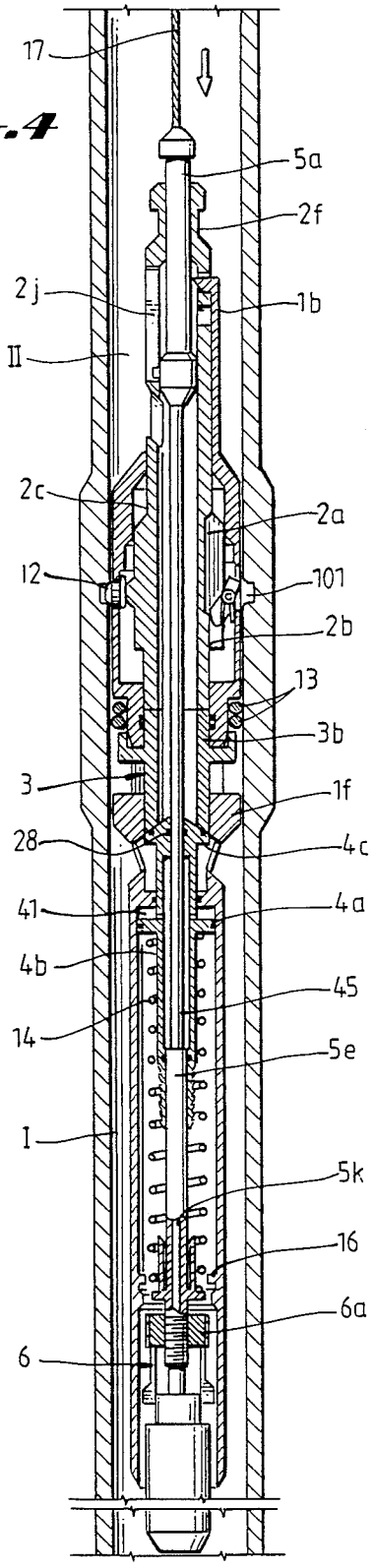

When the tool is lowered down the tubing 100 of the well, its various components are in the situation shown in FIG. 3. The resilient hook 1b of the part 1 is engaged in the groove 2f of part 2 so that the keys 12 are level with the upper retracted zone 2c of the part 2 and are thus themselves retracted into the part 2. As the tool is lowered, the dogs 11 rub against the inside surface of the production column and retract resiliently where necessary. In contrast, the sealing rings 13 are resting in the smaller diameter portion 1d of the part 1 so that they do not come into contact with the inside surface of the tubing 100. The part 6 is locked in the part 1 with the two pegs 16 of the part 1 being lodged in corresponding notches 20 of the part 6 (see FIG. 8), and the part 5 is screwed in a high position relative to the part 6 with the collar 5g being at a distance above the top of the part 6. The parts 1, 5, and 6 are thus mutually locked together and the valve element 4c is in its open position at a distance from its seat 3c while the spring 14 is compressed between the collar 5g and the piston 4a.

After the tool has been lowered slightly below the connection portion having a landing nipple 100a of the tubing 100, it is raised so that the dogs 11 engage in the groove 101 and the part 1 is thus fixed in position. In addition, the traction applied to the cable 17 raises the part 5 which brings the part 2 with it, causing the hook 1*b* to lift out from the groove 2*f* and engage in the orifice 2*g*. This upwards displacement of the part 2 relative to the part 1 causes the latching keys 12 to engage in the groove 101 by virtue of the middle zone 2*d* camming them outwardly and also causes the dogs 11 to be retracted by virtue of being cammed by the larger radius zone 2*b* of the part 2. Raising the part 5 relative to the part 1 also has the effect of raising the part 6 inside the part 1 so that it escapes from the pegs 16 each of which was engaged in a locking position in a corresponding one of the above-mentioned notches 20 provided in the projection 61 and in the diametrically opposite projection (see FIG. 12). Each peg 6 then encounters the projection 60 situated immediately below the projection 61 so that when the cable 17 is subsequently lowered causing the part 6 to move downwardly (see FIG. 4), the peg 16 encounters the projection 61 which cams it towards the following projections 62, 64, . . . without leaving the peg 16 any chance of returning into the notch 20. The part 6 is thus permanently released and, when the cable 17 is released, the part 5 is also free to move downwardly inside the part 1. This movement reduces the volume of the hydraulic chamber 41 and consequently increases the volume of the chamber 45 so that the part 4 (and in particular the valve element 4*c* thereon) is caused to move upwardly under the action of the spring 14. The valve element encounters its seat 3*c* and urges the entire part 3 to which the seat 3*c* *lbelongs upwardly, and in particular it moves the ring 3b* upwardly thereby forcing the sealing rings 13 out from the smaller diameter zone 1*d* and into the larger diameter zone 1*c* so that they are compressed against the inside surface of the tubing 100 and thereby provide sealing between regions I and II of the tubing 100 situated respectively above and below the sealing rings (see French patent application No. 85 12 892). Finally, the valve element 4*c* is pressed in a closure position against its seat 3*c* since the part 3 comes into abutment against the part 2. The above-specified regions I and II of thetubing 100 are thus isolated from each other.

When the said regions I and II are to be put into communication with each other by opening the valve constituted by the valve element 4*c* and its seat 3*b*, traction is exerted on the cable 17 (see FIG. 5). The part 5 moves upwardly until the seat 6*c* of the part 6 come into abutment with the shoulder 1*i* of the part 1, and its piston 5*e* reduces the volume of the hydraulic chamber 45 thereby increasing the volume of the hydraulic chamber 41 and consequently lowering the part 4 together with the valve element 4*c* with a multiplied force. When the valve opens in this way, the regions I and II of the production column are put into communication with each other via: the annular gap between the tubing and the sleeve 1*g* of the part 1; orifices 1*j* through the wall of said part 1 between the tube 1*g* and the portion 1*f* thereabove; the annular gap following the seat 3*c* between the portion 5*c* of the part 5 and the inside surface of the parts 2 and 3; and the orifices 2*k* through the wall of the part 2. At the same time, the part 5 also raises the part 6 so that its sleeve 6*a* passes between the pegs 16 and the peripheral projections from said sleeve co-operate with the pegs 16 to rotate the parts 6 through a fraction of a turn on the threaded portion 5*h* of the part 5 which is prevented from rotating by the peg 2 engaged in the slot 2*j* of the part 2. This rotation of the part 6 causes it to rise slightly relative to the part 5.

When the cable 17 is again released, the valve 4*c* closes under the action of the spring 14 assisted by the pressure $P_1$ of the fluid in the well, and the part 6 turns through another fraction of a turn.

Thus, by successively raising and lowering the cable 17, the valve 4*c*, 3*c* is respectively opened and closed, and the traction force required is relatively small because of the reduced force difference across the valve element and because the force actually applied thereto is amplified by means of the tool's hydraulic mechanism. In addition, there is no need to provide pressure equalization between the upstream and downstream sides of the valve element prior to opening the valve.

Finally, the indexing part 6 rises far enough along the threaded end 5*h* of the part 5 for its resilient legs 6*b* to escape from the end portion 5*i* of the part 5 (see FIG. 6) and to spring inwardly towards the tool axis. Thereafter, when further traction is applied to the cable 17 in order to open the valve 3*c*, 4*c*, the feet 6*c* of said legs 6*b* move past the shoulder 1*i*, thereby increasing the stroke of the part 5. Its claws 5*f* engage on the bottom end 4*d* of the part 4, thereby locking the spring 14 and preventing the valve from closing again. SimultaneouslY, the larger diameter portion 5*b* of the part 5 pushes the hook 1*b* outwardly and by virtue chamfered tip 15*b*, the hook escapes from the hole 2*g* and engages in the hole 2*h* so that the part 2 also moves relative to the part 1 and brings its retracted zone 2*e* level with the latching keys 12. The keys are thus retracted into the tool and the tool is now unlocked and may be raised to the surface using the cable 17.

The number of opening/closing cycles to which the tool's valve may be subjected is adjustable and depends on the initial position given to the indexing part 6 on the threaded portion 5*h* of the part 5.

I claim:

1. A closure tool for the tubing of a well containing a fluid under pressure, said tool being designed to be temporarily fixed inside the tubing or to form an integral portion thereof, and including a valve capable of being actuated to close or to open the tubing to the passage of well fluid, wherein said valve is coupled to a hydraulic mechanism comprising first and second piston-and-cylinder assemblies having respective variable volume chambers of different cross-sectional areas, said chambers communicating with each other and being filled with a hydraulic liquid, wherein the piston of the first assembly acts on the valve in its closure direction under the effect of the pressure of the hydraulic liquid to which it is subjected, said piston having an inside face in contact with the hydraulic liquid which is of larger cross-sectional area than the cross-sectional area of the inside face of the piston of the second assembly, thereby obtaining a multiplying effect on the force applied to the piston of the second assembly in order to cause the valve to open.

2. A tool according to claim 1, wherein the piston of the second assembly has an outside cross-sectional area which is subjected to the pressure of the well upstream from the valve, which area is greater than the cross-sectional area of the inside face of said piston.

3. A tool according to claim 1, wherein the piston of the second assembly slides in the corresponding cylinder along the longitudinal axis of the tool, and wherein it is disposed in such a manner that when it is urged to the end of the tool which is the top end when the tool is installed in a well, it causes the volume of the chamber of said assembly to be reduced.

4. A tool according to claim 1, wherein the valve comprises a valve element and a complementary seat, and wherein the valve element is fixed to the piston of said first assembly.

5. A tool according to claim 4, wherein the hydraulic mechanism is coaxial in structure.

6. A tool according to claim 5, wherein said valve element is fixed to a cylindrical tube whose axis is parallel to the direction of valve element displacement, said tube having the piston of said first assembly projecting outwardly therefrom in the form of an annular piston slidably mounted in a fixed cylindrical tube which constitutes the side wall of the cylinder of the first assembly and which is closed by a transverse partition situated between the valve element and the piston, said tube fixed to said valve element being mounted to slide in sealed manner through said partition, and said tube also constituting the side wall of the chamer of said second assembly, which chamber communicates with the chamber of said first assembly via at Ieast one orifice through said wall, the piston of said second assembly being slidably mounted in said tube and being fixed to an actuator rod capable of sliding in sealed manner through said valve element and having a cable attached thereto for causing said valve to open when traction is applied to the cable by displacing said valve element via said hydraulic mechanism.

7. A tool according to claim 6, designed to be temporarily fixed inside the tubing, wherein the tube constituting the side wall of said first assembly extends beyond said partition delimiting the chamber of said first assembly in the form of a generaIly tubular portion including at least one dog and at least one latching key capable of being retracted into said tubular portion and of being caused to project radially out therefrom in order to engage in a peripheral groove included in a landing nipple of said tubing provided at the location where the tool is to be situated, radial movements of said dog and said latching key being controlled by a tubular part which is movable in the direction of the longitudinal axis of the tool and which is disposed coaxially inside said tubular portion into which the dog and key may be retracted and including camming zones at differing radiuses for engaging said dog and said latching key.

8. A tool according to claim 7, wherein said tubular part having camming zones is capable of occupying three predetermined positions relative to said tubular portion into which the dog and the latching key may be retracted, said positions comprising a first position in which said dog is free to project under the effect of a spring and said latching key is retracted, a second position in which said dog is retracted and said latching key is extended, and a third position in which both the dog and the latching key are retracted, said tubular part being moved from its first position to its second position and then to its third position under the control of longitudinal displacements of the piston rod of said second assembly under the effect of successive traction forces applied to the cable attached to said rod.

9. A tool according to claim 8, wherein said tubular portion is initially in its first position and wherein said valve member displaces said tubular portion to its second position on the first occasion that said valve member is closed under the control of said piston rod of said second assembly.

10. A tool according to claim 8, wherein said piston rod of said second assembly is coupled to an indexing member which advances by one step each time said piston rod executes a go-and-return stroke corresponding to an opening and closing cycle of the valve, and wherein said indexing member limits the stroke of the piston rod in the valve opening direction until a predetermined number of steps have been accomplished, after which said member allows said piston rod stroke to continue further, thereby causing said tubular part to move from its second position to its third position.

11. A tool according to claim 10, wherein said piston rod and said tube fixed to said valve member are provided with hooking members whereby they lock together when the rod performs its extended stroke which unlocks the tool, the valve member then being maintained in its open position.

* * * * *